US008070194B2

(12) United States Patent
Houis

(10) Patent No.: US 8,070,194 B2
(45) Date of Patent: Dec. 6, 2011

(54) MECHANISM FOR INSTALLING A CONTROL TURNING HANDLE OF A DOOR LOCK AND ITS DEINSTALLING TOOL

(75) Inventor: Richard Houis, Nantes (FR)

(73) Assignee: Cyclope, Nantes (FR)

( * ) Notice: Subject to any disclaimer, the term of this patent is extended or adjusted under 35 U.S.C. 154(b) by 838 days.

(21) Appl. No.: 12/092,823

(22) PCT Filed: Nov. 6, 2006

(86) PCT No.: PCT/EP2006/068126

§ 371 (c)(1),
(2), (4) Date: May 7, 2008

(87) PCT Pub. No.: WO2007/051853

PCT Pub. Date: May 10, 2007

(65) Prior Publication Data

US 2008/0252086 A1 Oct. 16, 2008

(30) Foreign Application Priority Data

Nov. 7, 2005 (FR) ..... 05 53360

(51) Int. Cl.
*E05B 1/00* (2006.01)
*E05B 3/00* (2006.01)

(52) U.S. Cl. ..... 292/347; 292/336.3; 292/348; 292/DIG. 27; 70/224; 16/412

(58) Field of Classification Search ..... 292/336.3, 292/347–355, DIG. 27; 16/412, 413; 70/224
See application file for complete search history.

(56) References Cited

U.S. PATENT DOCUMENTS

| | | | | | |
|---|---|---|---|---|---|
| 48,024 | A | * | 5/1865 | Nobles | 292/348 |
| 481,519 | A | * | 8/1892 | Ashley | 292/348 |
| 1,519,500 | A | * | 12/1924 | Miller | 292/356 |
| 1,519,503 | A | * | 12/1924 | Norwood et al. | 292/356 |
| 1,799,253 | A | * | 4/1931 | Rogers | 292/350 |
| 2,190,951 | A | | 2/1940 | Roach | |
| 3,044,817 | A | * | 7/1962 | Marcante | 292/336.3 |
| 4,145,939 | A | | 3/1979 | Garrison | |
| 4,161,891 | A | | 7/1979 | Bossert | |
| 4,588,221 | A | | 5/1986 | Miller et al. | |

(Continued)

FOREIGN PATENT DOCUMENTS

DE 37 562 C 11/1886

(Continued)

*Primary Examiner* — Carlos Lugo
(74) *Attorney, Agent, or Firm* — Young & Thompson

(57) ABSTRACT

The invention relates to an installing mechanism and its deinstalling tool for a control turning handle (150) of a lock on an actuating rod (17) comprising two assemblies (E1, E2) that interact via a bayonet-type assembly by an axial engagement in the direction of the leaf then a rotation in a circular arc branch, in a second direction opposite the first direction around the axis of the rod, of the second assembly (E2) on the first set (E1), characterized in that each circular arc branch comprises an engagement limit stop upon which an associated stub rests, and a retractable stop for rotationally blocking the associated stub in the circular arc branch. The invention is particularly for use in a hygienic handle.

16 Claims, 7 Drawing Sheets

U.S. PATENT DOCUMENTS

| | | | | |
|---|---|---|---|---|
| 5,048,379 | A | 9/1991 | Gramera et al. | |
| 5,190,327 | A * | 3/1993 | Lin | 292/348 |
| 6,223,572 | B1 * | 5/2001 | Marttinen | 70/370 |
| 6,386,602 | B1 * | 5/2002 | Lan | 292/336.3 |
| 6,668,689 | B1 | 12/2003 | Lai | |
| 2005/0156441 | A1 | 7/2005 | Tsai | |

FOREIGN PATENT DOCUMENTS

| | | | |
|---|---|---|---|
| GB | 19848 | A | 0/1911 |
| GB | 204 178 | A | 9/1923 |
| GB | 2 389 141 | A | 12/2003 |

* cited by examiner

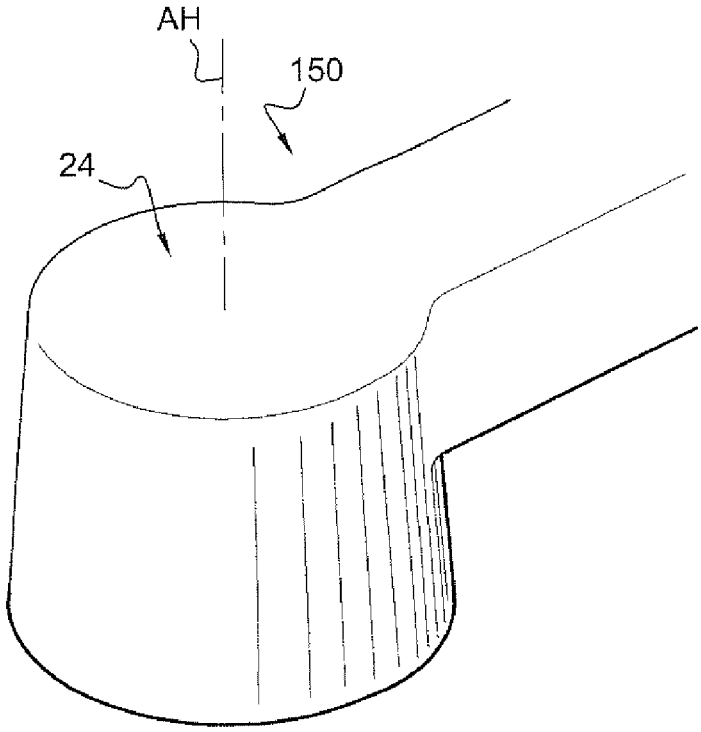
Fig. 1
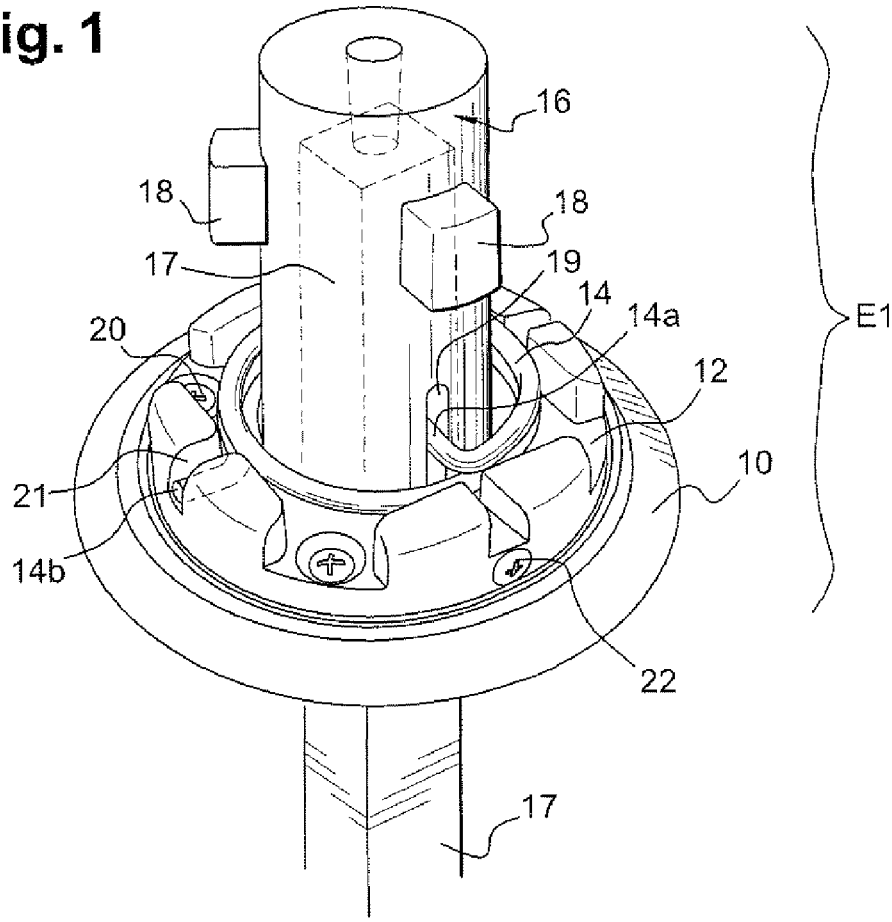

MECHANISM FOR INSTALLING A CONTROL TURNING HANDLE OF A DOOR LOCK AND ITS DEINSTALLING TOOL

TECHNICAL FIELD OF THE INVENTION

The invention relates to a mechanism for fitting an operating handle, and more specifically to a mechanism for fitting a handle for operating a lock with which the opening panel of a door is equipped and which is fitted such that it can turn, in a first direction, from a rest position toward which the handle is elastically returned.

PRIOR ART

A fitting mechanism such as this generally comprises a spindle for turning the lock and which extends axially at right angles to the plane of the opening panel of the door, and an arrangement mounted on the handle capable of accepting the operating spindle in order to turn it and which comprises a first assembly which is designed to be fixed and immobilized axially on the operating spindle, and a second assembly incorporated into a hub of the handle, the first and second assemblies being joined together by means of a bayonet-type fitting,

- the first assembly comprising a portion which is mounted such that it turns with the operating spindle and which comprises at least one radially directed lug;
- the second assembly comprising, for each lug, an L-shaped slot comprising an axial slideway and an arc-shaped branch so that an axial translational movement, followed by a rotational movement, allow the lug to engage in the associated slot to effect said bayonet fitting by engaging the second assembly on the first assembly, axially in the direction of the opening panel and then rotating it about the axis of the spindle in a second direction the opposite to said first direction.

An easy-fit mechanism such as this is intended to be used in the field of public health and hygiene such as, for example, in the field of medicine and particularly in a hospital environment, in the field of foodstuffs, which are fields in which there may be a need to remove door handles frequently for more in-depth cleaning.

A conventional rotary door knob is practically impossible to handle without using the hands, particularly when a mechanism such as a lock has first of all to be actuated before the opening panel or leaf of the door is opened by rotating it about its vertical axis embodied by hinges.

Now, the hands are the chief way in which harmful germs and bacteria are transmitted. Contamination is transmitted by hand.

One of the solutions is to design operating members that can be actuated without using the hands, particularly by using the arm, forearm or wrist so as to create a physical break in the transmission of so-called "hand-transmitted" bacteria and viruses.

An additional solution is to design an easy fit and easily removable mechanism so that the handles can regularly be removed for more in-depth cleaning (sterilizing, chemical treatment, etc.).

A bayonet-fit mechanism is known particularly from document U.S. Pat. No. 4,588,221.

SUMMARY OF THE INVENTION

The present invention proposes a fitting mechanism of the aforementioned type that is easy to remove.

To this end, the mechanism is characterized in that characterized in that each arc-shaped branch of the slot comprises an end-of-engagement-travel stop against which the associated lug bears, and a retractable stop to prevent the associated lug from rotating in the arc-shaped branch.

According to other features of the invention:

- the retractable stop is a stop that can be elastically deformed in order to allow the handle to be removed by turning it in said second direction of rotation;
- the retractable stop is a retractable peg which is positioned angularly facing said axial slideway and which is mounted such that it can move axially between;
- a rest position toward which the peg is elastically urged and in which the peg projects axially into the arc-shaped branch to constitute said stop; and
- a retracted position that allows the lug to engage axially in the axial slideway and then in the arc-shaped branch;
- each retractable peg is made of a magnetic material so as to allow it to be made to retract using a magnetic field;
- each retractable peg is mounted such that it can slide, in a cylinder of the second assembly, against the action of a spring which is mounted compressed between the axial blind end of the cylinder and the retractable peg;
- the first assembly comprises:
- a mounting ring fixed to the door around said portion;
- and a return spring which is interposed between the mounting ring and the portion so as elastically to return the operating spindle toward its angular rest position by turning it;
- the portion mounted on the operating spindle comprises:
- a base sub-portion;
- and a coaxial end sub-portion;

these two sub-portions collaborating by means of complementary teeth so as to allow angular adjustment of one sub-portion with respect to the other sub-portion and thus allow the angular position of the rotary handle to be adjusted with respect to the spindle,

- the mechanism comprises a means of adjusting the rest position of the lock bolt;
- the means of adjusting the bolt is an adjusting screw, the body of which is screwed into the mounting ring and the free end of which butts against a contact area belonging to the portion so as to allow the rest position of the lock bolt to be adjusted;
- the adjusting means comprises an adjusting ring positioned around the base sub-portion and which comprises a stop finger in contact with a contact area of the sub-portion, said adjusting ring being adjustable in terms of rotation with respect to the mounting ring between several angular positions so as to cause said base sub-portion to rotate with the adjusting ring so as to adjust the rest position of the bolt;
- the adjusting ring comprises a toothed radial tab which is kept fixed in terms of rotation by means of a pair of toothed jaws, these being a fixed jaw which is formed in the mounting ring and a moving jaw which belongs to a clamp screwed onto the mounting ring.

The invention also proposes a tool for fitting the mechanism according to the invention, characterized in that it comprises a housing intended to accommodate the exterior part of the hub of the handle and in that it comprises magnets capable axially of attracting the retractable pegs.

The fitting tool is also characterized in that it comprises a socket intended to collaborate with the lugs of the portion in order to adjust the angular position of the handle.

BRIEF DESCRIPTION OF THE DRAWINGS

Other features and advantages of the invention will become apparent from reading the detailed description which will follow, for an understanding of which reference will be made to the attached drawings in which:

FIG. 1 is a partial schematic view in exploded perspective of a fitting mechanism according to a first embodiment of the invention;

DETAILED DESCRIPTION OF THE DRAWINGS

Figure 2:
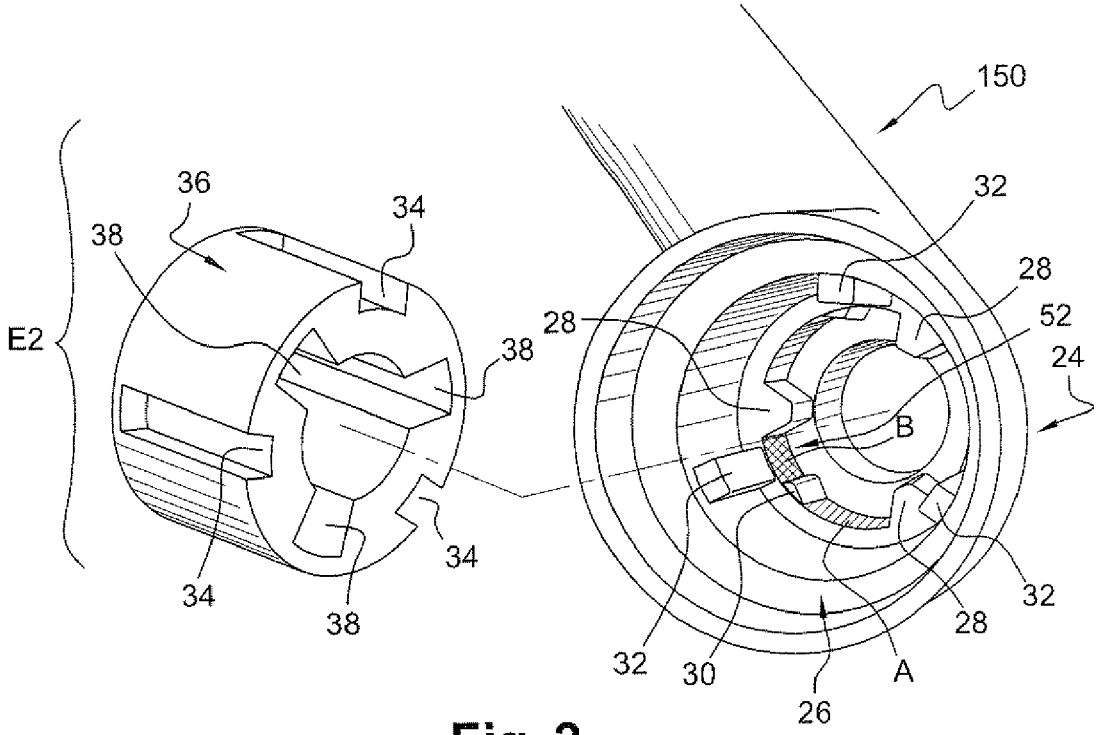
FIG. 2 is a view in exploded perspective of the two main components that make up the handle with its improved hub according to the first embodiment of the invention.

In the description which will follow elements which are identical, analogous, similar or fulfill the same function will be denoted by the same reference numerals.

In the description and in the claims the terminology "axial" and "radial" will be adopted nonlimitingly with reference to the axis of rotation of the door handle and the terminology "vertical", "horizontal", "top", "bottom", "upper", "lower", etc., will be used with reference to the orientation of the opening panel of the door.

The mechanism for fitting a handle capable of accepting an operating spindle for turning it comprises:

- a first assembly E1 illustrated in FIG. 1 and which is capable of being fixed to an operating spindle 17 with respect to which the first assembly E1 is axially immobilized along the axis AH of FIG. 1;
- and a second assembly E2 illustrated in detail in FIG. 2 which forms an integral part of a hub 24 of a handle 150.

Figure 3:
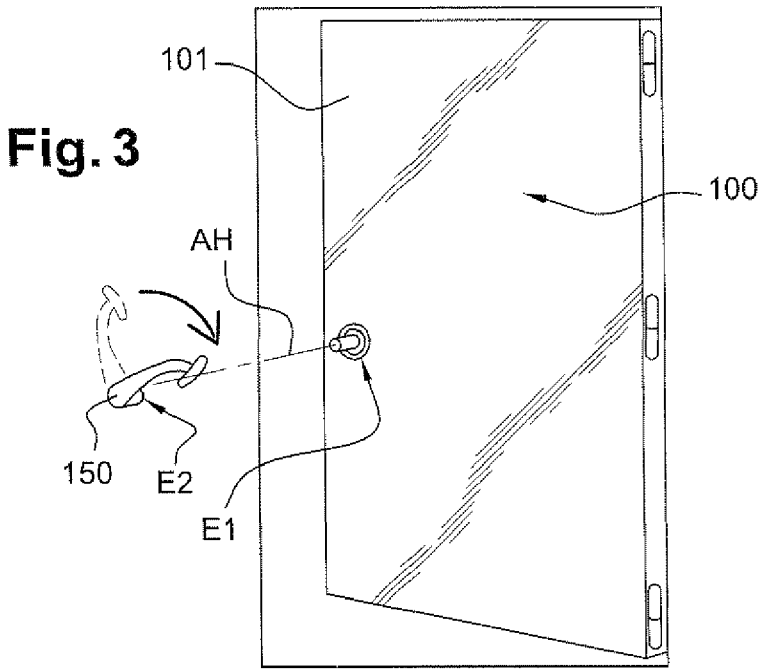
FIG. 3 is a schematic view illustrating the method of fitting a handle according to the invention on the opening panel of a door.

As can be seen in FIG. 3, the mechanism collaborates with a door lock, of the type having a moving bolt which collaborates with a fixed strike borne by the door frame, known in the prior art and comprising in particular the spindle 17 which allows the door 100 to be opened from an angular rest position toward which the handle 150 is elastically returned, that is to say to cause the bolt to retract or move into a non-obstructing position.

In position on the door 100, the handle 150 and the spindle 17 are mounted so that they can be turned about a common horizontal axis of rotation AH.

According to the first embodiment, the first assembly E1 is mounted and fixed axially on the operating spindle 17 of the door 100, for example as a tight axial push fit or, as an alternative, by any other means of assembly and of attachment such as, for example, by the use of a diametral pin.

The first assembly E1 mainly comprises a portion 16, a mounting ring 12, a sealing washer 10 and a rotational return spring 14.

The mounting ring 12 is intended to be attached permanently to the external face 101 of the opening panel of the door 100.

The mounting ring 12 constitutes that part of the first assembly E1 which is mounted on the door 100. It is intended to be fitted securely to the opening panel of the door 100 using axial mounting screws 20 or any other equivalent means.

The sealing washer 10 is inserted between the opening panel of the door 100 and the mounting ring 12 to prevent any contamination of the handle. The sealing washer 10 generally comprises concentric axial grooves (not depicted in detail) to accept the annular end edges of the first assembly E1 and of the hub 24 of the handle 150.

The sealing washer thus performs a dual sealing function, in particular sealing against contamination between the opening panel and the ring and between the first assembly and the hub.

In order to avoid local wear on the face 101 of the opening panel as a result of friction from the first assembly E1, the mechanism also comprises an anti-wear sheet inserted between the sealing washer 10 and the plane of the opening panel, made of a suitable material such as a light metal.

The main portion 16 is intended to be fitted onto the end of the operating spindle 17 coaxial with the axis AH about which the handle 150 turns.

The portion 16 for this purpose comprises, in its base adjacent to the opening panel, a hole of square cross section that complements the cross section of the spindle 17 so that it can accept the operating spindle 17 and provide a rotational connection between the two.

According to the various embodiments, the portion 16 has a substantially frustoconical or cylindrical shape and its base closest to the opening panel is mounted such that it is free to turn, at least over a determined angular sector, in the mounting ring 12.

The portion 16 also comprises, at its distal end, radially extending lugs 18 of which there are three in this instance and which are uniformly angularly distributed about the central axis of the portion 16.

The portion 16 comprises an axial slot 19 cut into its base, which opens into the external wall and the purpose of which will be explained later.

The first assembly E1 comprises a return spring 14 which is an elastic metal wire spring inserted angularly between the mounted ring 12 and the main portion 16 so as constantly to exert a return torque in order elastically to return the operating spindle 17 about the axis AH by turning it toward its angular rest position which is the position in which the bolt protrudes.

The spring 14 is fitted initially in a state of tension or preload by virtue of a clamping screw 22 which is screwed radially into the mounting ring 12 and the free end of which is housed in the axial/longitudinal slot 19 so as to prevent the portion 16 from turning, and therefore prevent its elastic return action, to make the first assembly E1 easier to fit.

The free end sections 14*a* and 14*b* of the spring 14 are housed respectively in the longitudinal slot 19 and in a cutout 21 formed for this purpose in the mounting ring 12 so as constantly to urge the portion 16 to turn relative to the ring 12, particularly once the clamping screw 22 has been definitively removed.

According to another embodiment of the invention, a person skilled in the art will be able to replace the wire spring with any other equivalent spring that performs the same function, such as a leaf spring for example.

The second assembly E2, incorporated into the hub 24 of the handle 150, comprises an entity which in this instance is crimped into the hub 24 and is made up of the elements or components depicted in FIG. 2.

The hub 24, depicted in greater detail in FIG. 2, delimits an internal cavity 26 which is open axially toward the opening panel of the door and in which cavity end-of-engagement stops 28, retractable stops 30 and guides, or ribs, 32 projecting radially toward the axis and directed axially and which are uniformly angularly distributed inside the internal cavity 26 are formed.

For this purpose, the body of the handle 150 and particularly its hub 24 with the cavity 26 of complex internal profile are advantageously made by molding out of plastic.

The three axial guides 32 are intended to be housed axially in complementary external slots 34 in order to guide and prevent the rotation of a complementary cylindrical piece 36 which is positioned in the internal cavity 26 of the hub 24 so that once it has been inserted and nested axially in the internal cavity 26 of the hub, the piece 36 forms an integral part of the hub. The handle and its hub are thus made in two parts, particularly so as to allow the complex shapes of the cavity 26 to be molded.

The internal piece 36, depicted out of hub 24 in FIG. 2, is nested inside the internal cavity 26 by hot forming or may be mounted by any other equivalent means, such as by screw-fastening for example, and with the hub 24 and its cavity 26 constitutes the second assembly E2 of the mechanism capable of collaborating with the first assembly E1.

The internal piece 36 attached to the cavity 26 is an annular cylindrical piece which also comprises axial internal slideways or slots open at their opposite ends 38, of which there are three uniformly angularly distributed and each of which constitutes a passage or path for the axial insertion or extraction of an associated lug 18 belonging to the first assembly E1.

Figure 7:
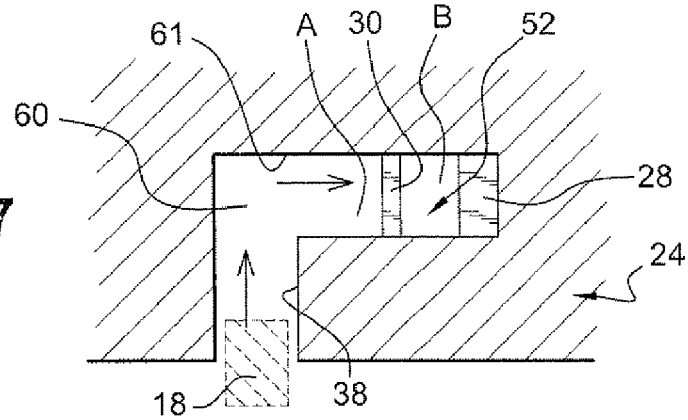
FIG. 7 is a diagram illustrating the bayonet fastening according to a first embodiment.

Thus, when the handle 150 is being fitted onto the opening panel of the door previously equipped with the first assembly E1, each lug 18 is axially engaged in a slideway 38 by axial translation until it reaches an axial position in which the lug 18 faces a first concave cylindrical arc-shaped contact surface A as illustrated in FIG. 7.

By turning in one direction, clockwise when lugying FIG. 3, for opening the door 100 (drawing back the bolt), the lug 18 becomes housed between an end-of-engagement stop 28 and a retractable stop 30 and facing a concave second cylindrical contact surface B so that the handle can be bayonet fitted, with its incorporated second assembly E2, onto the opening panel 100 already equipped with its assembly E1.

The functional surfaces A and B and the stops 28 and 30 are produced by molding in the cavity 26.

When the hub 24 and the internal piece 36 are in the definitive angular position for the fitting of the handle, the slideway 38 and the cylindrical arc-shaped contact surfaces A and B delimit an L-shaped slot 60 illustrated in FIG. 7, with an axial branch consisting of the slideway 38, and an arc-shaped branch 61 delimited by the cavity 26, the piece 36 and the concave cylindrical arc-shaped surfaces A and B.

The retractable stop 30 has enough rigidity to keep the lug in contact with the stop 28. The stop 30 is thus shaped and is sufficiently elastically deformable to allow the lug 18 to escape from its angular "prison" between the two stops 28 and 30 when enough rotational torque is applied in the opposite direction, the counterclockwise direction, in order to remove the handle 150.

Prior to fitting the handle, the user whose task it is to fit the handle will have installed and attached the first assembly E1 on the operating spindle 17 on the opening panel of the door 100.

Once the first assembly has been fitted on the opening panel of the door 100 using the mounting screws 20, the user removes the clamping screw 22 and releases the spring 14 which makes the portion 16 turn in the direction that causes the bolt (not depicted) to protrude.

In the case of so-called "hygienic" handles, the main body intended to accept one of the user's forearms is generally longer and the handle 150 is generally heavier than a "conventional" door handle.

The return spring 14 thus assists the lock elastic return mechanism in order to guarantee that the angular rest position of the handle 150 will be practically constant with the bolt in the protruding position.

The return spring 14 is stiff enough to apply a torque to the portion 16, and therefore to the handle 150, via the lugs 18 and to prevent the mere weight of the handle from operating the lock.

The second assembly E2 of the hub 24 of the handle 150 is positioned by the user facing the first assembly E1 mounted on the opening panel of the door 100.

Thereafter, the fitter axially inserts the lugs 18 in the sideways 38 of the cavity 26 of the hub 24. In order to obtain the bayonet fastening, the user turns the handle 150 in the clockwise direction for opening the lock so that each lug 18 becomes housed between two opposing stops 28 and 30 of the circular surface B. The need for the stops 30 to be elastically deformed gives the fitter the tactile feedback that he has crossed a threshold and "locked" the handle in the fitted position, from which position the handle will thence forth rotate as one with the spindle 17.

Figure 4:
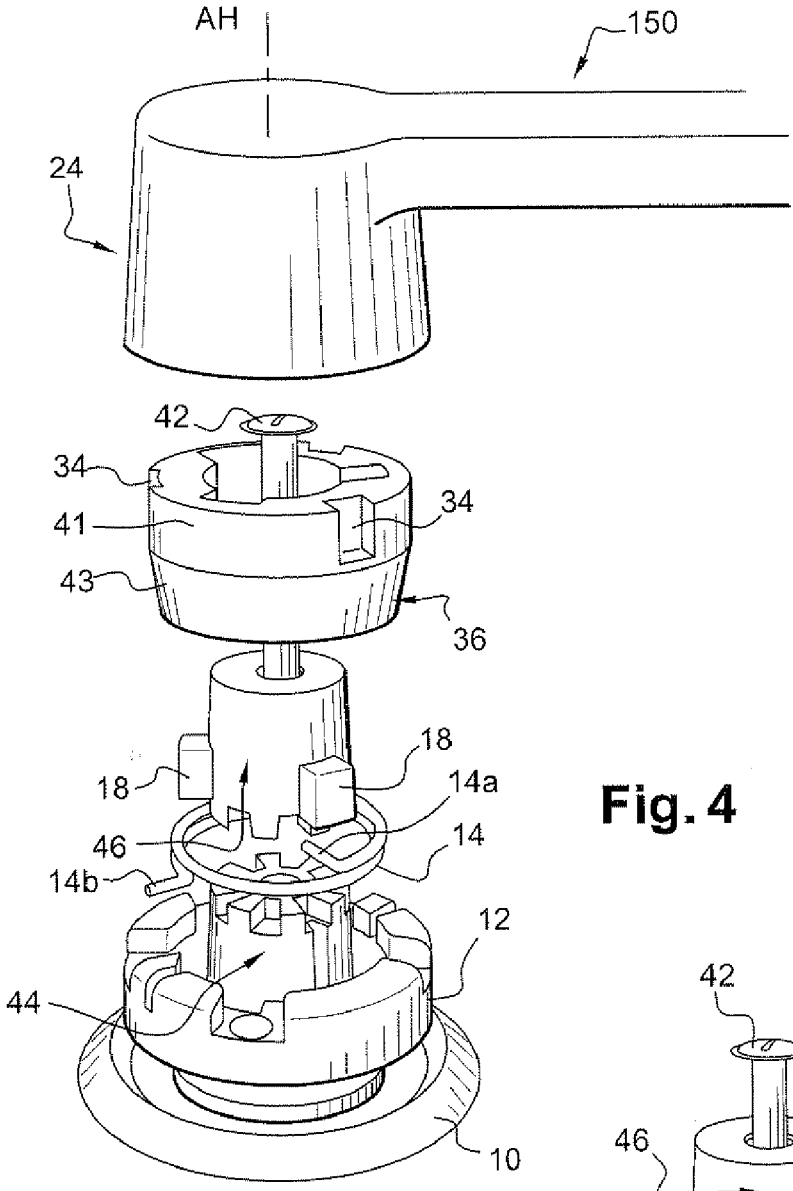
FIG. 4 is a view similar to that of FIG. 1 depicting a fitting mechanism according to a second embodiment of the invention.
Figure 5:
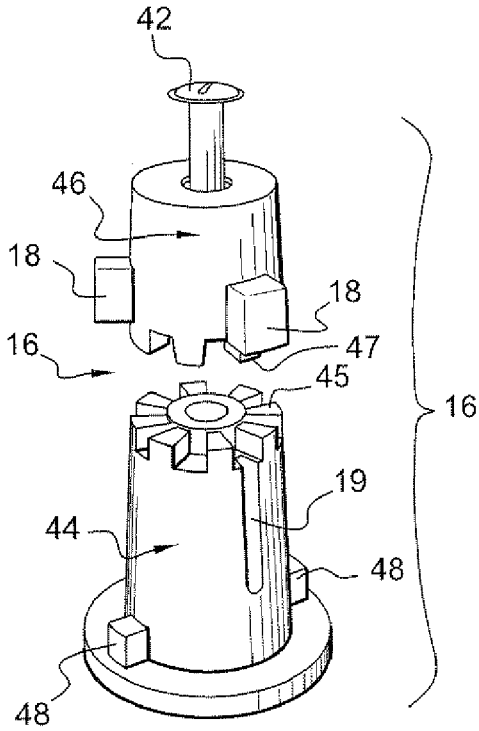
FIG. 5 is an exploded perspective view of the two sub-portions that make up the first assembly depicted in FIG. 4.

According to the second exemplary embodiment, the invention proposes a first assembly E1, illustrated in FIG. 4, of which the main feature that distinguishes it from the first exemplary embodiment that has just been described is that the portion 16 is made up of two sub-portions or semi-portions 44 and 46.

The two sub-portions collaborate with one another by means of teeth 45 and 47 distributed angularly in a ring in a uniform and complementary manner on each of the opposing radial end faces of the two sub-portions 44 and 46 respectively.

This allows the angular rest position of the lugs 18 borne by the distal free-end sub-portion 46 to be adjusted precisely with respect to the proximal base sub-portion 44 and therefore allows the angular rest position of the handle 150 with respect to the opening panel to be adjusted. The pitch of this fine adjustment corresponds to the pitch of the complementary teeth or notches 45 and 47.

This adjustment is needed particularly in the case of hygienic handles that can be actuated by the wrist or forearm. A conventional door handle generally has a body which at rest runs in a horizontal plane. By contrast, a hygienic handle needs to extend substantially upwards so as to be at user arm or forearm height.

The angular adjustment thus makes it possible to adapt in particular the hygienic handle to suit, on the one hand, the various fields of application and, on the other hand, the build of the various users in order to avoid any twisting, particularly of the back, when in use.

The two sub-portions, namely the proximal base sub-portion 44 and the distal free-end sub-portion 46 are axially immobilized relative to one another by means of a screw 42 and a nut (not depicted) positioned in the blind end of the housing designed to accept the operating spindle 17.

To perform adjustment, the screw 42 is slackened, a new angular position is chosen, and the screw 42 is re-tightened.

The base sub-portion 44 housed inside the mounting ring 12 comprises stop areas 48 which constitute symmetric angular supports 48 which in this instance are diametrically opposed.

Figure 6:
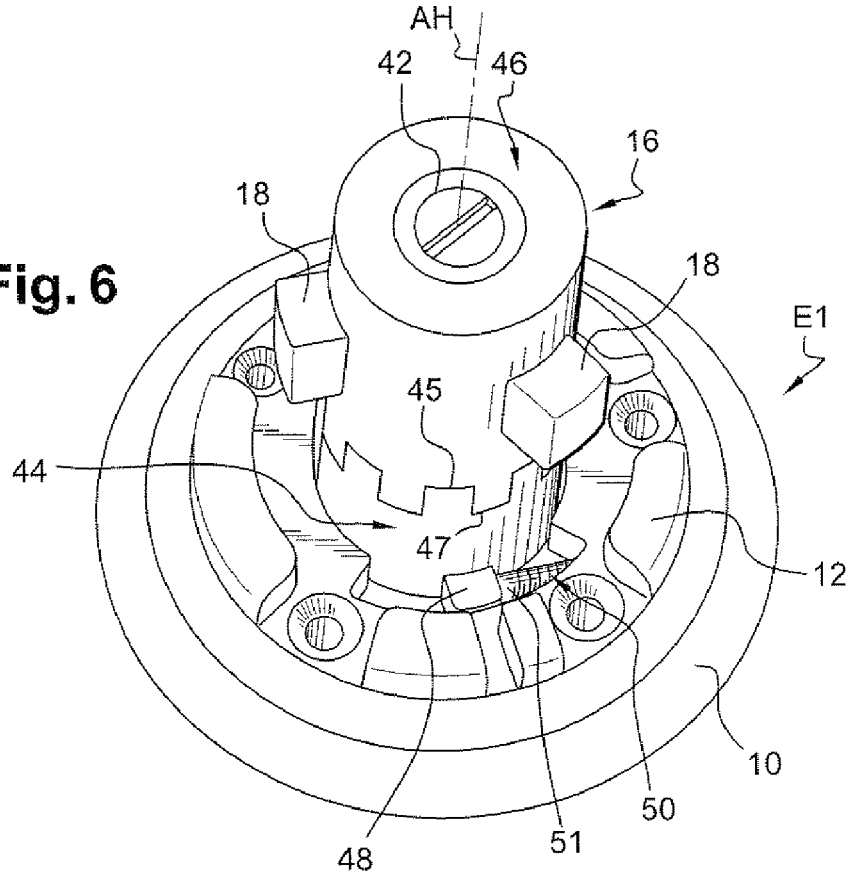
FIG. 6 is another perspective view of the first assembly depicted in FIG. 4.

The first assembly E1 here comprises another adjusting screw 50 visible in FIG. 6 which is screwed substantially tangentially into the mounting ring 12 and the free end 51 of which bears in angular abutment against one of the contact areas 48 of the base sub-portion 44.

The adjusting screw 50 is accessible from the outside of the ring and turning it in one direction or the other by screwing or unscrewing it allows the rest (protruding) position of the lock bolt to be adjusted.

When the adjusting screw 50 is slackened off, its free end acts on the area 48 and the bolt is made to protrude further relative to the edge face of the door.

When the adjusting screw 50 is tightened, the bolt has a tendency to be drawn back into the lock which makes closing the door easier when the user pulls the handle towards him.

The internal piece 36 in the second exemplary embodiment has convex lateral faces 41 and 43 with shallow and opposite gradients to make it easier to crimp into the cavity 26 of the hub 24.

The user can adjust the desired angular position of the handle 150 by angularly offsetting the sub-portion 46 with respect to the sub-portion 44. To make this adjustment easier, the distal end sub-portion 46 may have markings (not depicted) to identify a lug 18 and offset it by the desired angle in order to obtain a handle set "low", that is to say at a small angle with respect to the horizontal or a handle set "high" that forms a larger angle with the horizontal.

Thereafter, the user fits and locks the handle in the same way as for the first exemplary embodiment of the invention.

Figure 8:
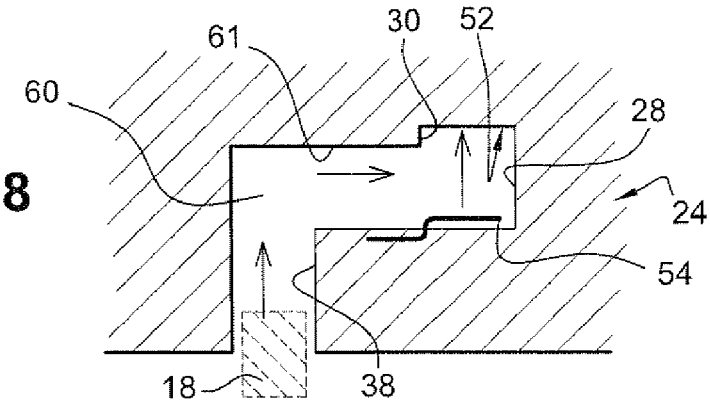
FIG. 8 is a diagram illustrating the bayonet fastening according to a second exemplary embodiment.
Figure 9:
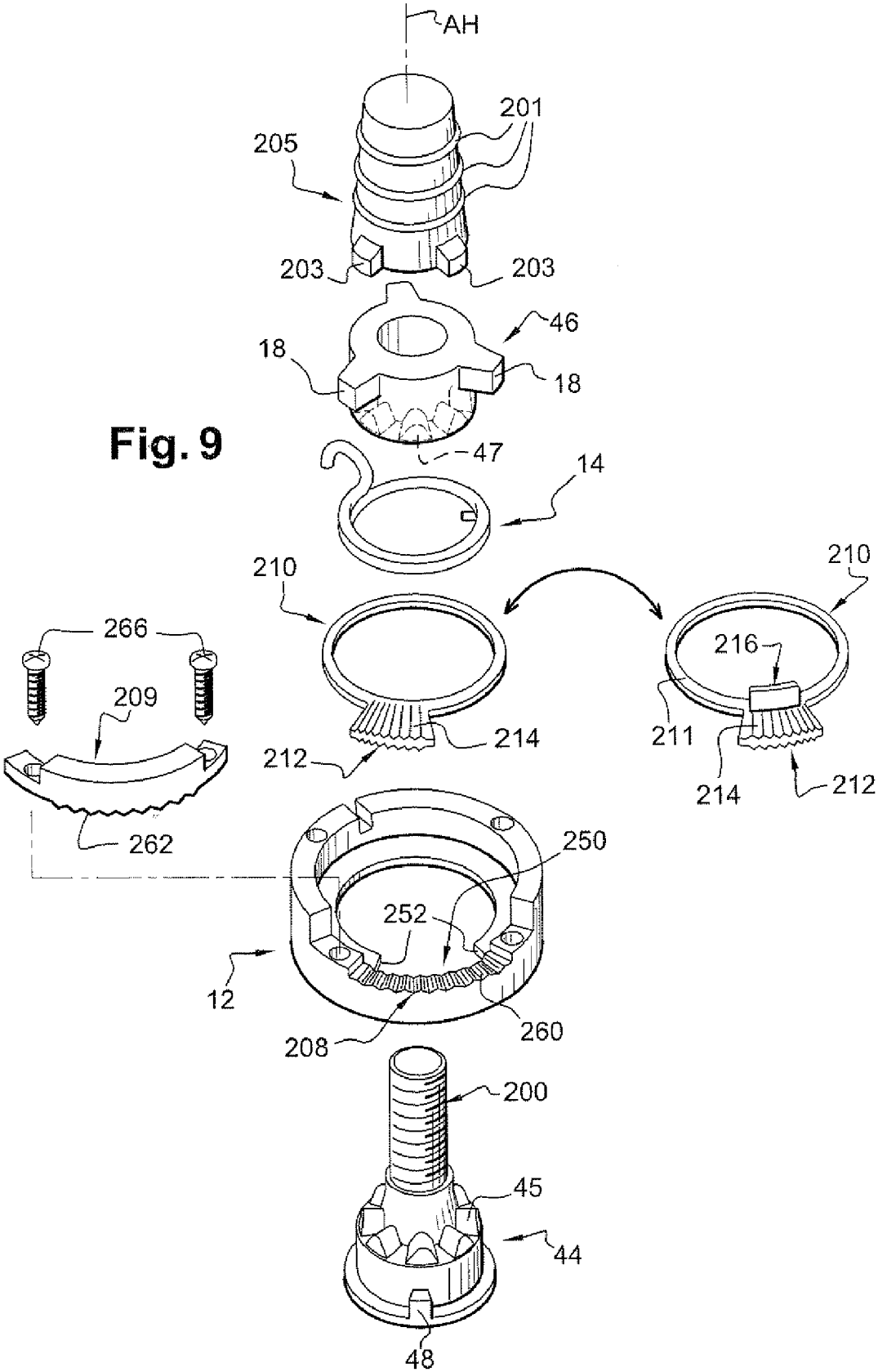
FIG. 9 is an exploded perspective view similar to the views of FIGS. 4 and 5 and illustrating the main components of the first assembly of the mechanism according to a third exemplary embodiment of the invention and in which the adjusting ring is depicted in views from above and from below.
Figure 10:
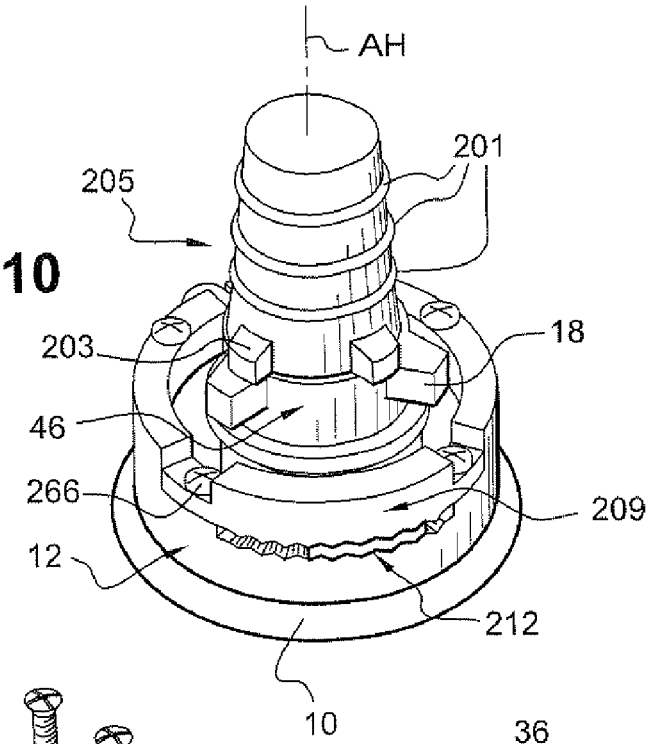
FIG. 10 is a view of the components of the first assembly of FIG. 9 in an assembled position.
Figure 11:
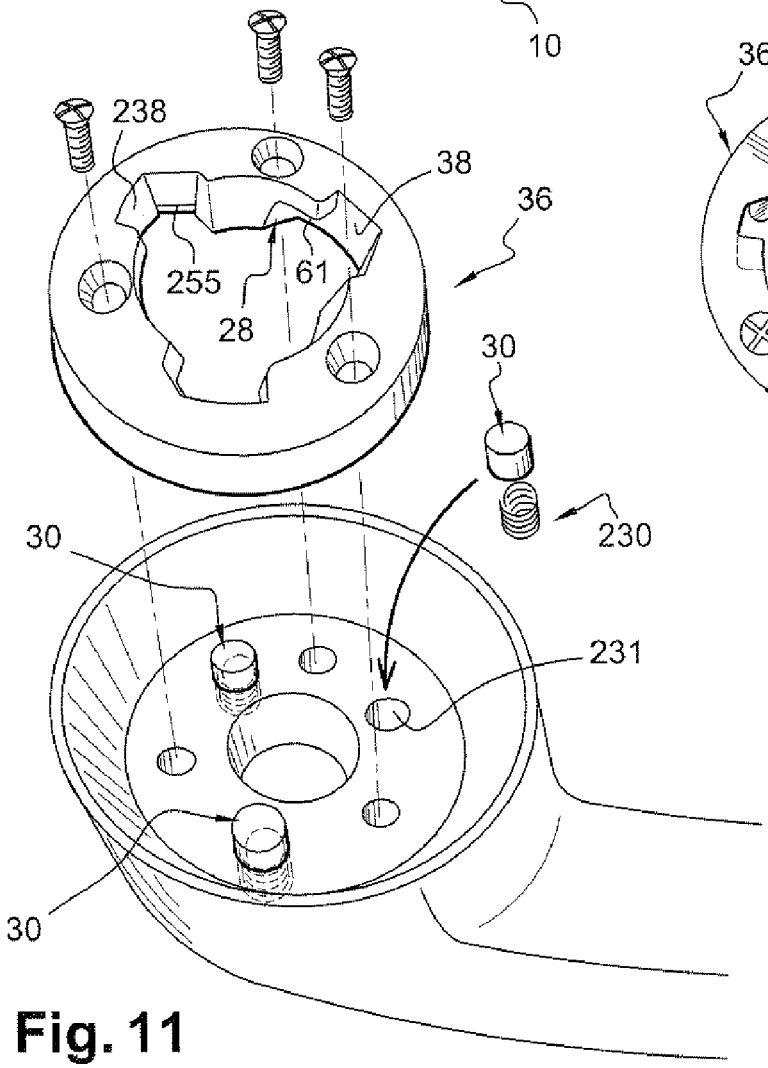
FIG. 11 is an exploded perspective view similar to that of FIG. 2 and illustrating the main components of the second assembly of the mechanism according to the third exemplary embodiment.
Figure 12:
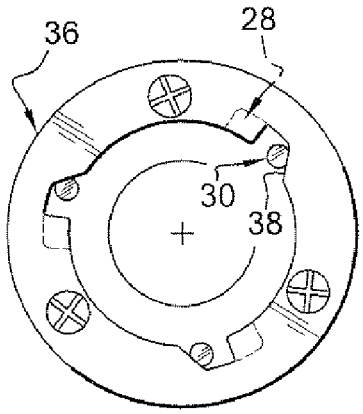
FIG. 12 is an axial end-on view of the second assembly of FIG. 11 with the components in the assembled position.

According to an alternative form of embodiment, depicted schematically in FIG. 8, the L-shaped slot 60 has a different profile. The end-of-travel stop 28 and a stop 30 define a housing 52 in which the lug 18 is accommodated axially at the end of the bayonet-fitting travel. A leaf spring 54 then urges the lug 18 axially toward the door 100 so as to press the handle 150 against the door 100 and keep the handle 150 in its locked position. In addition, the spring 54 keeps the lug between its opposing stops 28 and 30.

To remove the handle, the user pulls the handle axially toward himself, downward when lugying FIG. 8, and then dismantles the mechanism by rotating and translating it in the opposite direction to the direction used for fitting it.

The spring 54 with the stops 28 and 30 and the housing 52 constitute retractable stop means equivalent to those of the elastically deformable retractable stop according to the first exemplary embodiment.

According to an undepicted alternative form of embodiment of the invention, the spring 54 is positioned in the internal cavity 26 in such a way as to press the lug 18 into the housing 52, urging it axially toward the handle 150. To remove the handle 150, the user has then to push the handle axially toward the door and unlock the mechanism by rotating and translating it in the opposite direction to the direction used for fitting it.

FIGS. 9 to 15 depict a third preferred exemplary embodiment of a mechanism for fitting a door handle, and of the combined tool used for fitting and removing it.

In this third exemplary embodiment, the two sub-portions 44, 46 of the first assembly E1 are joined together by means of a distal end nut 205 which is axially tapped and which is mounted on a threaded spindle 200 secured to the base sub-portion 44 in such a way that once the angular position of the lugs 18 has been adjusted, all that is required is for the nut 205 to be screwed onto the threaded spindle 200.

The body of the nut 205 has a slightly frustoconical shape and its external wall has radial grooves in which O-ring seals 201 are fitted to make it easier to insert and withdraw the first assembly E1 into and from the second assembly E2 and prevent any radial play between the two assemblies E1 and E2.

In addition, the nut 205 has at its base radial claws 203 for turning the nut in both directions and which are designed to collaborate with the fitting tool 240 which comprises complementary housings 204 so as to tighten the nut 205 to a tightening torque that is enough to prevent any accidental disconnection of the two sub-portions 44 and 46.

Thus, angular adjustment of the handle 150 requires less effort than in the previous embodiments. Indeed, all that is required is simply for the nut 205 to be slackened off in order to act on the end sub-portion 46 once the first assembly E1 has been fitted onto the operating spindle 17 that operates the lock.

The fitting mechanism according to the third exemplary embodiment also comprises a means of adjusting the rest position of the lock bolt, to a different design.

The means of adjusting the rest position of the bolt consists in a flat adjusting ring or collar 210.

The ring 210 comprises, on its proximal annular face 211, a stop finger 216 directed axially toward the ring 12 and the base sub-portion 44.

The adjusting ring comprises, in line with the axial finger 216, a radial tab 212 which has teeth 214 on its two opposite faces.

The adjusting ring 210 is mounted around the base portion 44 in such a way that its stop finger 216 is in contact with the contact area 48 of the base sub-portion 44. Thus, the base sub-portion 44 turns as one with the adjusting ring 210.

The user adjusts the position of the bolt by making the adjusting ring 210 turn, carrying with it the base sub-portion 44.

The mounting ring 12 comprises an angular cutout 250 delimited by two stops 252 in which the axial finger 216 and the area 216 are housed to allow the sub-portion 44 and the adjusting ring 210 some degree of angular travel with respect to the mounting ring 12, for the purposes of adjustment.

The first assembly E1 comprises a pair of jaws 208, 209, these being a fixed jaw 208 which is formed in the mounting ring 12 and comprises which teeth 260 that complement the teeth 214 of the underside of the radial tab 212, and a moving jaw 209 which consists of a clamp comprising teeth 262 and which can be screwed onto the mounting ring 12 in such a way that once the clamp has been screwed onto the ring 12 by screws 266, the radial tab 212 is firmly prevented from rotating being immobilized between the two jaws 208, 209 which are clamped axially together.

For the various fitting and removal operations, and for adjusting the rest position of the bolt, the user has a combined tool 240 which in particular comprises a socket 246 that is the imprint of the lugs 18.

Once the first assembly E1 of a fixing mechanism has been fitted, for example, on each side of the opening panel of the door, the user positions the socket 246 over the lugs 18 of the first mechanism assembly opposite the one he wishes to adjust.

In order to cause the bolt to protrude further or be drawn back, the user simply turns the tool 240 about the axis AH of the lock.

When the position of the bolt has been adjusted, the fitter angularly moves the radial tab 212 of the adjusting ring 210 of the mechanism that he wishes to adjust in order to bring the stop finger 216 into contact with the contact pad 48 of the base sub-portion 44.

The fitter then axially screws and tightens the moving jaw 209 against the fixed jaw 208 in order to prevent the radial tab 212, and therefore the adjusting ring 210, from turning relative to the mounting ring 12.

The user thus prevents the adjusting ring 210 from turning by immobilizing the radial tab 212 in the desired angular position.

Just as in the previous embodiments, the second assembly E2 mounted inside the hub 24 of the handle 150 comprises end-of-travel stops 28 and retractable stops 30 which are radially and uniformly distributed and between which an associated lug 18 is held in position at the end of the bayonet-type fitting.

As can be seen in FIGS. 13A to 13D each retractable stop 30 is a retractable cylindrical peg 30 which can be positioned angularly facing the axial slideway 38 and which is mounted such that it can move axially with respect to the hub 24 of the handle 150.

The retractable peg 30 can occupy two axial positions, these being:

an axial rest position toward which the peg 30 is elastically urged, here by a coil spring 230, and in which the peg 30 projects axially into the arc-shaped branch 61 in order to constitute said retractable stop 30; and a retracted position, retracted against the action of the force exerted by the spring 230, to allow the lug 18 to be engaged axially in the axial slideway 38 and then in the arc-shaped branch 61.

More specifically, each retractable peg 30 is slideably mounted in a cylinder cylindrical axial hole 231 formed in the hub 24 and in which the spring 230 is positioned, this spring being mounted such that it is axially compressed between the axial blind end 235 of the cylinder 231 and the transverse end face 233 of the peg 30.

Figure 13A:
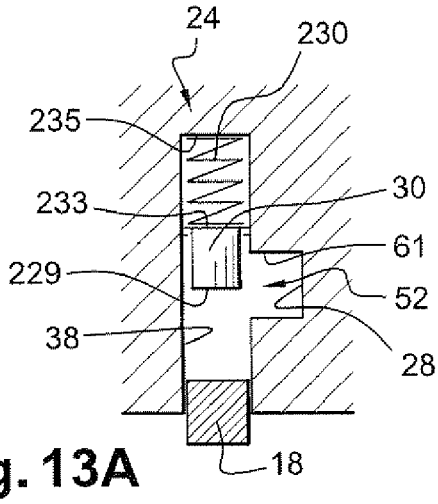
FIGS. 13A to 13D are diagrams similar to those of FIGS. 7 and 8 illustrating the bayonet fastening according to the third exemplary embodiment.

In order to fit the door handle 150 to the door, the fitter axially engages each of the lugs 18 in an associated axial slideway 38 (FIG. 13A).

Figure 13B:
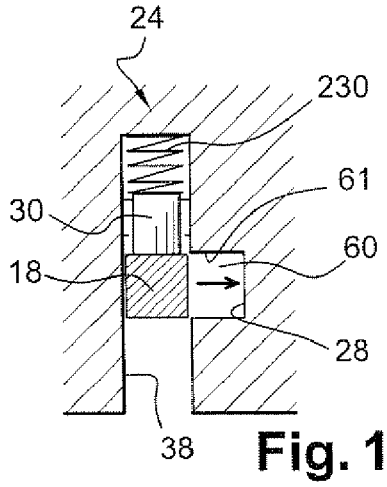

Each lug 18 axially acts upon the transverse end face 229 of the retractable peg 30 pushing the peg 30 axially into its retracted position thereby compressing the spring 230 (FIG. 13B).

To obtain the bayonet fastening, the user then turns the handle in the direction for opening the lock and, by turning, engages each of the lugs 18 in an associated arc-shaped branch 61.

Figure 13C:
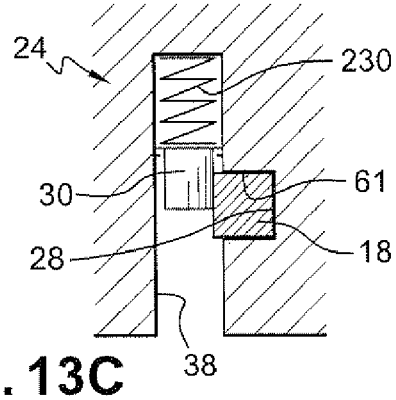

Each retractable peg 30 therefore regains its axial rest position by once again projecting into the axial slideway 38 and each lug 18 thus finds itself immobilized again between an end-of-travel stop 28 and a peg 30 which constitutes a retractable stop 30 (FIG. 13C).

According to a favored embodiment of the invention, the retractable pegs 30 are made of a magnetic material so that they can be made to retract using a magnetic field.

Figure 13D:
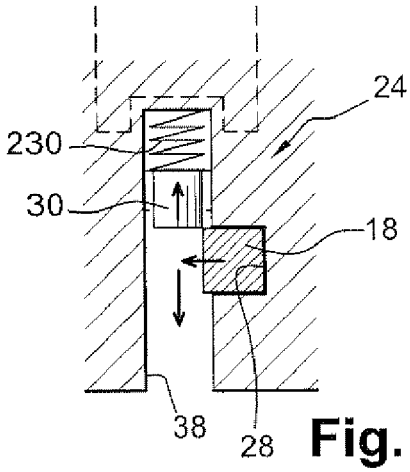
Figure 14:
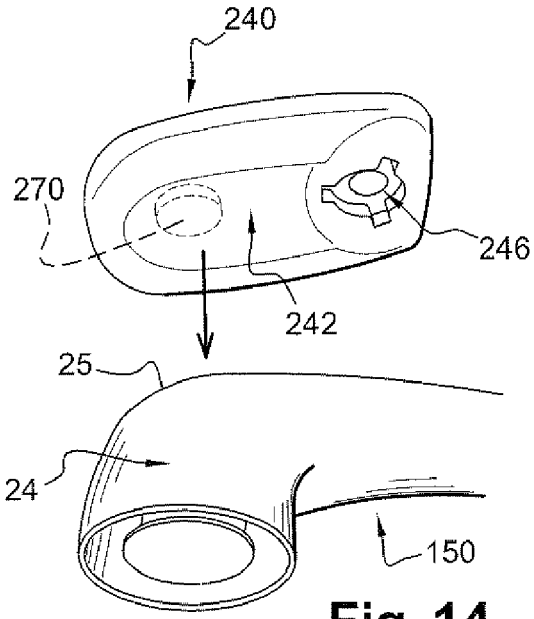
FIGS. 14 and 15 are schematic perspective views of a multi-purpose tool for fitting, adjusting and removing the mechanism according to the third exemplary embodiment.
Figure 15:
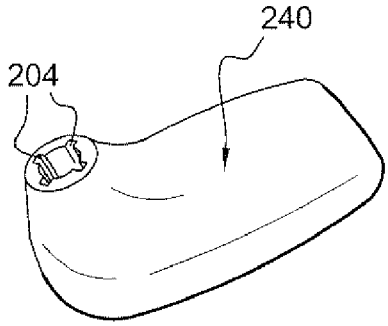

Thus, to remove the handle 150, the user uses a fitting tool 240 that comprises magnets 270 capable axially of attracting the retractable pegs 30 into the retracted position in which the spring 230 is compressed, so as to release the lugs 18 by turning them in the arc-shaped branch 61 (FIG. 13D).

More specifically, the fitting tool 240 comprises a cavity 242 intended to accept the exterior part 25 of the hub 24 so as to act on the magnetic pegs 30 located in the hub 24.

To remove the handle, the user places the fitting tool 240 against the exterior part 25 of the hub 24 of the handle 150. Each retractable peg 30 then moves axially toward its retracted position thus releasing each lug 18 in the associated arc-shaped branch 61.

The fitter finally turns the handle 150 using the tool 240 in the opposite direction to the direction for opening the lock and is able to remove the handle 150.

In an advantage over the previous embodiments, a multi-purpose fitting tool 240 such as this makes it possible to reduce the number of tools and the time needed to fit/remove door handles.

The present invention and the various exemplary embodiments described hereinabove can be applied in a simplified manner to fixed handles of the type fitted to cupboards, certain doors, etc. In such cases, the portion is fixed directly to the cupboard door opening panel and the handle is fitted using the same bayonet fastening mechanism.

The invention claimed is:

1. A mechanism for fitting a lock-operating handle (150) with which the opening panel of a door (100) is equipped, which is mounted such that it can turn, in a first direction, from a rest position toward which the handle (150) is elastically returned, the mechanism comprising a spindle (17) for turning the lock and which extends axially at right angles to the plane of the opening panel of the door (100), and an arrangement mounted on the handle (150) capable of accepting the operating spindle (17) in order to turn it and which comprises a first assembly (E1) which is designed to be fixed and immobilized axially on the operating spindle (17), and a second assembly (E2) incorporated into a hub (24) of the handle (150), the first (E1) and second (E2) assemblies being joined together by means of a bayonet fitting, the first assembly (E1) comprising a portion (16) which is mounted such that it turns with the operating spindle (17), the first assembly further comprising lugs (18), a mounting ring (12), a spring (14), and a sealing washer (10), the second assembly (E2) comprising, for each lug (18), an L-shaped slot (60) comprising an axial slideway (38) and an arc-shaped branch (61) so that an axial translational movement, followed by a rotational movement, allow the lug (18) to engage in the associated slot (60) to effect said bayonet fitting, wherein each arc-shaped branch (61) of the slot (60) comprises an end-of-engagement-travel stop (28) against which the associated lug (18) bears, and a retractable stop (30) to prevent the associated lug (18) from rotating in the arc-shaped branch (61), and wherein the retractable stop (30) is a stop that can be elastically deformed in order to allow the handle (150) to be removed by turning it in said second direction of rotation.

2. The mechanism as claimed in claim 1, wherein, the mounting ring (12) is fixed to the door (100) around said portion (16); and and the return spring (14) is interposed between the mounting ring (12) and the portion (16) so as elastically to return the operating spindle (17) toward its angular rest position by turning it.

3. A mechanism for fitting a lock-operating handle (150) with which the opening panel of a door (100) is equipped, which is mounted such that it can turn, in a first direction, from a rest position toward which the handle (150) is elastically returned, the mechanism comprising a spindle (17) for turning the lock and which extends axially at right angles to the plane of the opening panel of the door (100), and an arrangement mounted on the handle (150) capable of accepting the operating spindle (17) in order to turn it and which comprises a first assembly (E1) which is designed to be fixed and immobilized axially on the operating spindle (17), and a second assembly (E2) incorporated into a hub (24) of the handle (150), the first (E1) and second (E2) assemblies being joined together by means of a bayonet fitting, the first assembly (E1) comprising a portion (16) which is mounted such that it turns with the operating spindle (17), the first assembly further comprising lugs (18), a mounting ring (12), a spring (14), and a sealing washer (10), the second assembly (E2) comprising, for each lug (18), an L-shaped slot (60) comprising an axial slideway (38) and an arc-shaped branch (61) so that an axial translational movement, followed by a rotational movement, allow the lug (18) to engage in the associated slot (60) to effect said bayonet fitting, wherein each arc-shaped branch (61) of the slot (60) comprises an end-of-engagement-travel stop (28) against which the associated lug (18) bears, and a retractable stop (30) to prevent the associated lug (18) from rotating in the arc-shaped branch (61), and wherein the retractable stop (30) is a retractable peg (30) which is positioned angularly facing said axial slideway (38) and which is mounted such that it can move axially between:

a rest position toward which the peg (30) is elastically urged and in which the peg projects axially into the arc-shaped branch (61) to constitute said stop (30); and a retracted position that allows the lug (18) to engage axially in the axial slideway (38) and then in the arc-shaped branch (61).

4. The mechanism as claimed in claim 3, characterized in that each retractable peg (30) is made of a magnetic material so as to allow it to be made to retract using a magnetic field.

5. The mechanism as claimed in claim 4, characterized in that each retractable peg (30) is mounted such that it can slide, in a cylinder (231) of the second assembly (E2), against the action of a spring (230) which is mounted compressed between the axial blind end (235) of the cylinder (231) and the retractable peg (30).

6. The mechanism as claimed in claim 5, wherein, the mounting ring (12) is fixed to the door (100) around said portion (16);

and the return spring (14) is interposed between the mounting ring (12) and the portion (16) so as elastically to return the operating spindle (17) toward its angular rest position by turning it.

7. A tool (240) for fitting the handle mechanism (150) as claimed in claim 4, further comprising a housing (242) intended to accommodate the exterior part (25) of the hub (24) of the handle (150) and in that it comprises magnets capable axially of attracting the retractable pegs (30).

8. The fitting tool (240) as claimed in claim 7, further comprising a socket (246) intended to collaborate with the lugs (18) of the portion (16) in order to adjust the angular position of the handle (150).

9. The mechanism as claimed in claim 4, wherein, the mounting ring (12) is fixed to the door (100) around said portion (16);

and the return spring (14) is interposed between the mounting ring (12) and the portion (16) so as elastically to return the operating spindle (17) toward its angular rest position by turning it.

10. The mechanism as claimed in claim 3, wherein, the mounting ring (12) is fixed to the door (100) around said portion (16);

and the return spring (14) is interposed between the mounting ring (12) and the portion (16) so as elastically to return the operating spindle (17) toward its angular rest position by turning it.

11. A mechanism for fitting a lock-operating handle (150) with which the opening panel of a door (100) is equipped, which is mounted such that it can turn, in a first direction, from a rest position toward which the handle (150) is elastically returned, the mechanism comprising a spindle (17) for turning the lock and which extends axially at right angles to the plane of the opening panel of the door (100), and an arrangement mounted on the handle (150) capable of accepting the operating spindle (17) in order to turn it and which comprises a first assembly (E1) which is designed to be fixed and immobilized axially on the operating spindle (17), and a second assembly (E2) incorporated into a hub (24) of the handle (150), the first (E1) and second (E2) assemblies being joined together by means of a bayonet fitting, the first assembly (E1) comprising a portion (16) which is mounted such that it turns with the operating spindle (17), the first assembly further comprising lugs (18), a mounting ring (12), a spring (14), and a sealing washer (10), the second assembly (E2) comprising, for each lug (18), an L-shaped slot (60) comprising an axial slideway (38) and an arc-shaped branch (61) so that an axial translational movement, followed by a rotational movement, allow the lug (18) to engage in the associated slot (60) to effect said bayonet fitting, wherein each arc-shaped branch (61) of the slot (60) comprises an end-of-engagement-travel stop (28) against which the associated lug (18) bears, and a retractable stop (30) to prevent the associated lug (18) from rotating in the arc-shaped branch (61), wherein the mounting ring (12) is fixed to the door (100) around said portion (16), and the return spring (14) is interposed between the mounting ring (12) and the portion (16) so as elastically to return the operating spindle (17) toward its angular rest position by turning it, and wherein the portion (16) mounted on the operating spindle (17) comprises:

a base sub-portion (44);

and a coaxial end sub-portion (46);

these two sub-portions (44, 46) collaborating by means of complementary teeth (45, 47) so as to allow angular adjustment of one sub-portion with respect to the other sub-portion and thus allow the angular position of the rotary handle (150) to be adjusted with respect to the spindle (17).

12. The mechanism as claimed in claim 11, further comprising a means of adjusting the rest position of the lock bolt.

13. The mechanism as claimed in claim 12, characterized in that the means of adjusting the bolt is an adjusting screw (50), the body of which is screwed into the mounting ring (12) and the free end of which butts against a contact area (48) belonging to the portion so as to allow the rest position of the lock bolt to be adjusted.

14. The mechanism as claimed in claim 12, characterized in that the adjusting means comprises an adjusting ring (210) positioned around the base sub-portion (44) and which comprises a stop finger (216) in contact with a contact area (48) of the sub-portion (44), said adjusting ring (210) being adjustable in terms of rotation with respect to the mounting ring (12) between several angular positions so as to cause said base sub-portion (44) to rotate with the adjusting ring (210) so as to adjust the rest position of the bolt.

15. The mechanism as claimed in claim 14, characterized in that the adjusting ring (210) comprises a toothed radial tab (212) which is kept fixed in terms of rotation by means of a pair of toothed jaws (208, 209), these being a fixed jaw (208) which is formed in the mounting ring (12) and a moving jaw (209) which belongs to a clamp (209) screwed onto the mounting ring (12).

16. The mechanism as claimed in claim 11, further comprising a means of adjusting the rest position of the lock bolt.

* * * * *